US009437379B2

(12) United States Patent
Shiu

(10) Patent No.: US 9,437,379 B2
(45) Date of Patent: Sep. 6, 2016

(54) KEY PLATE AND ILLUMINATED KEYBOARD HAVING THE SAME

(71) Applicant: Yun-Heng Shiu, New Taipei (TW)

(72) Inventor: Yun-Heng Shiu, New Taipei (TW)

( * ) Notice: Subject to any disclaimer, the term of this patent is extended or adjusted under 35 U.S.C. 154(b) by 256 days.

(21) Appl. No.: 14/247,781

(22) Filed: Apr. 8, 2014

(65) Prior Publication Data

US 2014/0326589 A1 Nov. 6, 2014

(30) Foreign Application Priority Data

May 3, 2013 (TW) ..... 102115920 A

(51) Int. Cl.
*H01H 13/02* (2006.01)
*H01H 13/83* (2006.01)

(52) U.S. Cl.
CPC ..... *H01H 13/83* (2013.01); *H01H 13/023* (2013.01); *H01H 2219/048* (2013.01); *H01H 2219/06* (2013.01); *H01H 2219/062* (2013.01); *H01H 2221/07* (2013.01)

(58) Field of Classification Search
CPC ..... H01H 13/02; H01H 13/83; H01H 13/023
USPC ..... 200/4, 5 A, 17 R, 18, 310, 341; 341/22; 345/168
See application file for complete search history.

(56) References Cited

U.S. PATENT DOCUMENTS 6,199,996 B1 * 3/2001 Katrinecz, Jr. ..... G06F 3/0202 200/314
6,803,903 B1 * 10/2004 Ostergard ..... H01H 13/702 200/5 A
7,283,066 B2 * 10/2007 Shipman ..... G06F 3/0202 200/319

* cited by examiner

*Primary Examiner* — Amy Cohen Johnson
*Assistant Examiner* — Marina Fishman
(74) *Attorney, Agent, or Firm* — WPAT, P.C., Intellectual Property Attorneys; Anthony King

(57) ABSTRACT

A key plate includes a light-permeable covering plate having a plurality of first key openings and includes a key symbol display plate disposed on the light-permeable covering plate and having a plurality of second key openings and a plurality of light-permeable key symbol blocks. The light-permeable key symbol blocks are positioned proximate to the second key openings, respectively. The second key openings correspond in position to the first key openings, respectively. Further provided is an illuminated keyboard with the key plate. Accordingly, the key plate and the illuminated keyboard feature simplified structure, low manufacturing costs, and short manufacturing process, prevent users' fingers from hiding symbols displayed on the keys in bright and dark environments, prevent the symbols displayed on the keys from getting blurred or smeared after long contact with the users' fingers, and feature variable appearance of the key symbol display plate.

6 Claims, 5 Drawing Sheets

20

KEY PLATE AND ILLUMINATED KEYBOARD HAVING THE SAME

CROSS-REFERENCE TO RELATED APPLICATION

This non-provisional application claims priority under 35 U.S.C. §119(a) on Patent Application No(s). 102115924 filed in Taiwan, R.O.C. on May 3, 2013, the entire contents of which are hereby incorporated by reference.

FIELD OF THE INVENTION

The present invention relates to key plates and illuminated keyboards having the same, and more particularly, to a key plate and an illuminated keyboard having the same which have a simple structure, incur low manufacturing costs, render the manufacturing process speedy, allow symbols displayed on keys to be seen by users rather than hidden by the users' fingers in bright and dark environments, prevent the symbols from getting blurred or smeared after long contact with the users' fingers, and render a key symbol display plate variable.

BACKGROUND OF THE INVENTION

Computers are indispensable to the daily life of people nowadays; hence, keyboards, which are tools of data input, are of vital importance. In general, people usually work with computers in a well-illuminated environment. However, to allow computers to be operable in dark environments, illuminated keyboards were invented. The symbols displayed by conventional illuminated keyboards have to be luminous. To this end, all the parts and components beneath the keys must be light-permeable so as for light rays to be guided to the luminous symbols displayed on the keys. As a result, the conventional illuminated keyboards are structurally complicated, poor in optical performance, uneven in symbol brightness, and difficult to design and manufacture. Moreover, the conventional illuminated keyboards incur high costs and necessitate a lengthy manufacturing process when marketed in different countries and thus required to display symbols, including characters, in the respective languages of the countries. Furthermore, when the conventional illuminated keyboards are operating in bright and dark environments, the luminous symbols displayed on the keys may be hidden by the users' fingers and thus invisible to the users. Also, the appearance of the conventional illuminated keyboards is invariable and thus monotonous. Last but not least, the symbols displayed on the keys of the conventional illuminated keyboards get blurred or smeared after long contact with the users' fingers.

Accordingly, it is imperative to invent a key plate and an illuminated keyboard having the same with a view to simplifying the structure of the illuminated keyboard, cutting its manufacturing costs, shortening its manufacturing process, preventing users' fingers from hiding the symbols displayed on the keys in bright and dark environments, preventing the symbols displayed on the keys of the illuminated keyboard from getting blurred or smeared after long contact with the users' fingers, and rendering the appearance of a key symbol display plate of the illuminated keyboard variable.

SUMMARY OF THE INVENTION

In view of the aforesaid drawbacks of the prior art, the inventor of the present invention conceived room for improvement in the prior art and thus conducted extensive researches and experiments according to the inventor's years of experience in the related industry, and finally developed a key plate and an illuminated keyboard having the same as disclosed in the present invention with a view to simplifying the structure of the illuminated keyboard, cutting its manufacturing costs, shortening its manufacturing process, preventing users' fingers from hiding the symbols displayed on the keys in bright and dark environments, preventing the symbols displayed on the keys of the illuminated keyboard from getting blurred or smeared after long contact with the users' fingers, and rendering the appearance of a key symbol display plate of the illuminated keyboard variable.

In order to achieve the above and other objectives, the present invention provides, in the first aspect thereof, a key plate, comprising: a light-permeable covering plate having a plurality of first key openings; and a key symbol display plate disposed on the light-permeable covering plate. The key symbol display plate has a plurality of second key openings and a plurality of light-permeable key symbol blocks. The light-permeable key symbol blocks are positioned proximate to the second key openings, respectively. The second key openings correspond in position to the first key openings, respectively.

As regards the key plate, the light-permeable covering plate is light-permeable in its entirety, or the margin of the light-permeable covering plate is opaque, and the periphery of the first key openings is light-permeable.

As regards the key plate, the key symbol display plate adheres to the light-permeable covering plate, is engaged with the light-permeable covering plate, or is changeable.

As regards the key plate, the light-permeable key symbol blocks are positioned to the top of the second key openings, respectively.

In the second aspect, the present invention provides an illuminated keyboard which comprises a light-permeable covering plate having a plurality of first key openings and a key symbol display plate disposed on the light-permeable covering plate. The key symbol display plate has a plurality of second key openings and a plurality of light-permeable key symbol blocks. The light-permeable key symbol blocks are positioned proximate to the second key openings, respectively. The second key openings correspond in position to the first key openings, respectively. The illuminated keyboard further comprises a key module disposed beneath the light-permeable covering plate. The key module has a plurality of keys and a light-permeable key holding plate. The keys are disposed at the light-permeable key holding plate and spaced apart from each other. The keys are disposed in the first key openings and the second key openings, respectively. The illuminated keyboard further comprises a light-permeable circuit film disposed beneath the key module. The illuminated keyboard further comprises a backlight device disposed beneath the light-permeable circuit film. The backlight device is provided in the form of a light guiding plate with a light source or in the form of an electroluminescent plate. The light guiding plate has a plurality of reflection blocks. The reflection blocks correspond in position to the light-permeable key symbol blocks, respectively. The electroluminescent plate corresponds in position to the light-permeable key symbol blocks. The illuminated keyboard further comprises a bottom casing disposed beneath the backlight device and coupled to the light-permeable covering plate so as to enclose the key module, the light-permeable circuit film, and the backlight device.

As regards the illuminated keyboard, the light-permeable covering plate is light-permeable in its entirety, or the margin of the light-permeable covering plate is opaque, and the periphery of the first key openings is light-permeable.

As regards the illuminated keyboard, the key symbol display plate adheres to the light-permeable covering plate, is engaged with the light-permeable covering plate, or is changeable.

As regards the illuminated keyboard, the light-permeable key symbol blocks are positioned to the top of the second key openings, respectively.

The illuminated keyboard further comprises a light-permeable fixing board disposed between the light-permeable circuit film and the backlight device.

The illuminated keyboard further comprises a reflector disposed between the backlight device and the bottom casing.

Accordingly, an key plate and an illuminated keyboard with the key plate of the present invention feature simplified structure, low manufacturing costs, and short manufacturing process, prevent users' fingers from hiding symbols displayed on the keys in bright and dark environments, prevent the symbols displayed on the keys from getting blurred or smeared after long contact with the users' fingers, and feature variable appearance of the key symbol display plate.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION OF THE PREFERRED EMBODIMENTS

Figure 1:
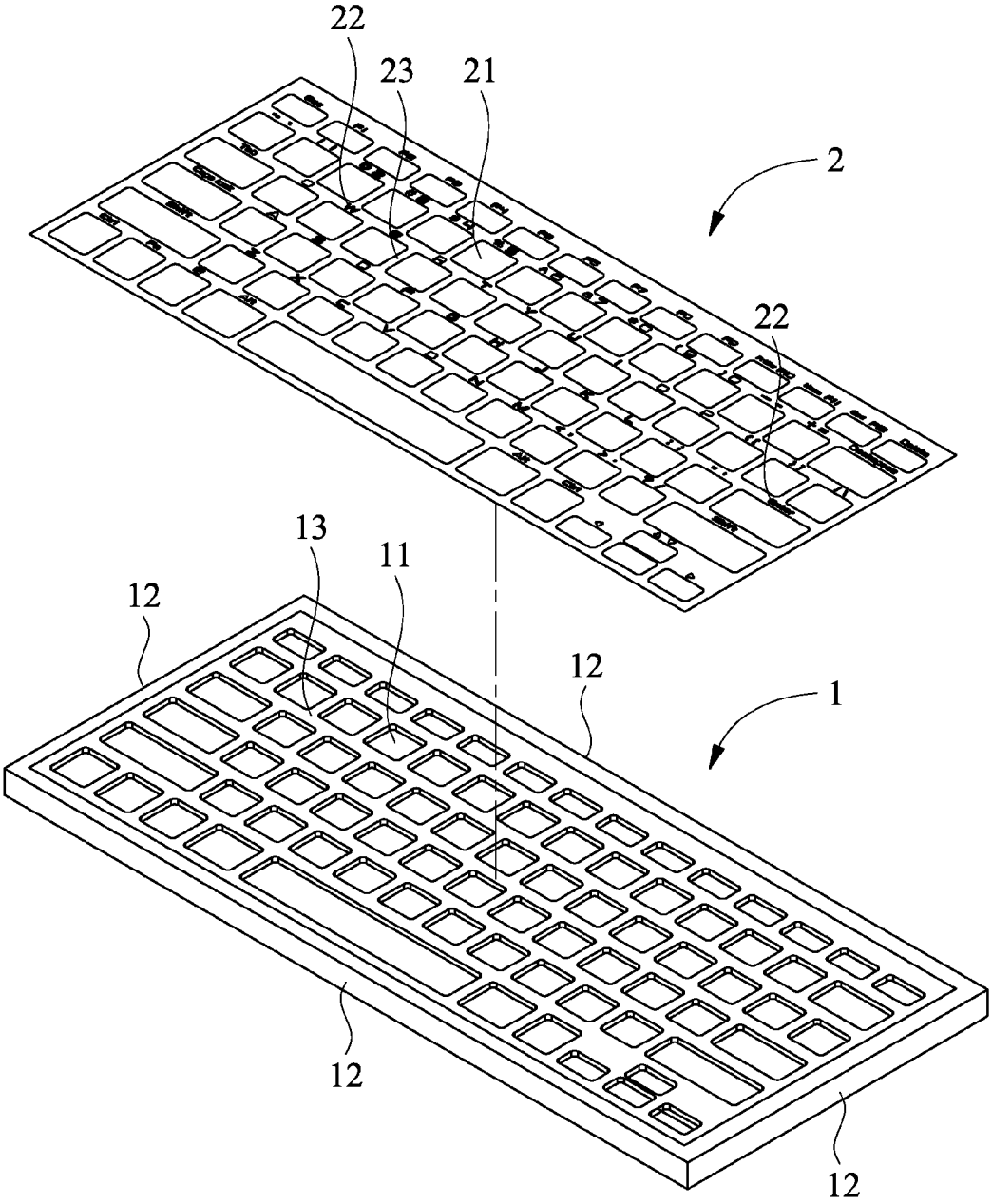
FIG. 1 is an exploded view of a key plate according to an embodiment of the present invention.

Referring to FIG. 1, there is shown an exploded view of a key plate 10 according to an embodiment of the present invention. As shown in the diagram, in the first aspect of the present invention, the key plate 10 comprises a light-permeable covering plate 1 and a key symbol display plate 2. The light-permeable covering plate 1 has a plurality of first key openings 11 for receiving a plurality of keys (not shown), respectively. The key symbol display plate 2 is disposed on the light-permeable covering plate 1. The key symbol display plate 2 adheres to the light-permeable covering plate 1. Alternatively, the key symbol display plate 2 is engaged with the light-permeable covering plate 1. Alternatively, the key symbol display plate 2 is fixed to the light-permeable covering plate 1 by whatever means. The key symbol display plate 2 has a plurality of second key openings 21 and a plurality of light-permeable key symbol blocks 22. The second key openings 21 receive the keys, respectively. The light-permeable key symbol blocks 22 come in the form of numerals, English letters, any foreign languages, and/or signs. The light-permeable key symbol blocks 22 are mounted on a support 23 of the key symbol display plate 2 and positioned proximate to the second key openings 21, respectively. For example, the light-permeable key symbol blocks 22 are positioned to the top, bottom, left or right of the second key openings 21. Moreover, the light-permeable key symbol blocks 22 correspond in position to a light-permeable support 13 of the light-permeable covering plate 1. Not only are the light-permeable key symbol blocks 22 on the key symbol display plate 2 light-permeable, but the other parts and components of the key symbol display plate 2 are either light-permeable (for example, of sufficiently low transmittance to render the light-permeable key symbol blocks 22 visible) or opaque. The second key openings 21 correspond in position to the first key openings 11, respectively, such that the first key openings 11 and the second key openings 21 can receive the keys, respectively.

As mentioned before, according to the present invention, the light-permeable key symbol blocks 22 of the key plate 10 are disposed on the key symbol display plate 2, and thus it is not necessary to change the structure and constituent material of the keys or parts and components beneath the keys (to a light-permeable material, for example) in order to admit a light beam. Moreover, according to the present invention, to apply the key plate 10 to different countries and present the symbols on the keys in their respective languages, it is only necessary to change the key symbol display plate 2 but not necessary to change all the keys. Hence, the key plate 10 of the present invention incurs low manufacturing costs but is advantaged by a speedy manufacturing process. Furthermore, according to the present invention, the light-permeable key symbol blocks 22 of the key plate 10 are disposed on the key symbol display plate 2 such that the users' fingers are unlikely to hide the light-permeable key symbol blocks 22 while the users are operating the illuminated keyboard in bright and dark environments, such that it is easy for the users to see and identify the symbols on the keys. Furthermore, it is unlikely that the users' fingers can come into contact with the light-permeable key symbol blocks 22 of the key plate 10, and thus the light-permeable key symbol blocks 22 are unlikely to get blurred or smeared.

As regards the key plate 10, the light-permeable covering plate 1 is light-permeable in its entirety. Alternatively, a margin 12 of the light-permeable covering plate 1 is opaque, and the periphery of the first key openings 11 (that is, the support 13 of the light-permeable covering plate 1) is light-permeable, such that the light-permeable covering plate 1 demonstrates diversity in terms of light permeability.

As regards the key plate 10, the key symbol display plate 2 is not only changeable but also variable in terms of pattern, color, and font of characters as needed. With the key symbol display plate 2 being changeable, the key plate 10 can work with different said key symbol display plates 2 in order to assume diverse appearance. Moreover, to suit the key plate 10 to different countries, it is only necessary to change the key symbol display plate 2, instead of all the keys, of the key plate 10, thereby cutting manufacturing costs, speeding up the manufacturing process, and enhancing ease of use at an international level.

As regards the key plate 10, the light-permeable key symbol blocks 22 are positioned to the top of the second key openings 21, respectively, to thereby fall into the range of the angles of view of the users, such that the users can instantly determine whether the symbols keyed in are correct.

Figure 2:
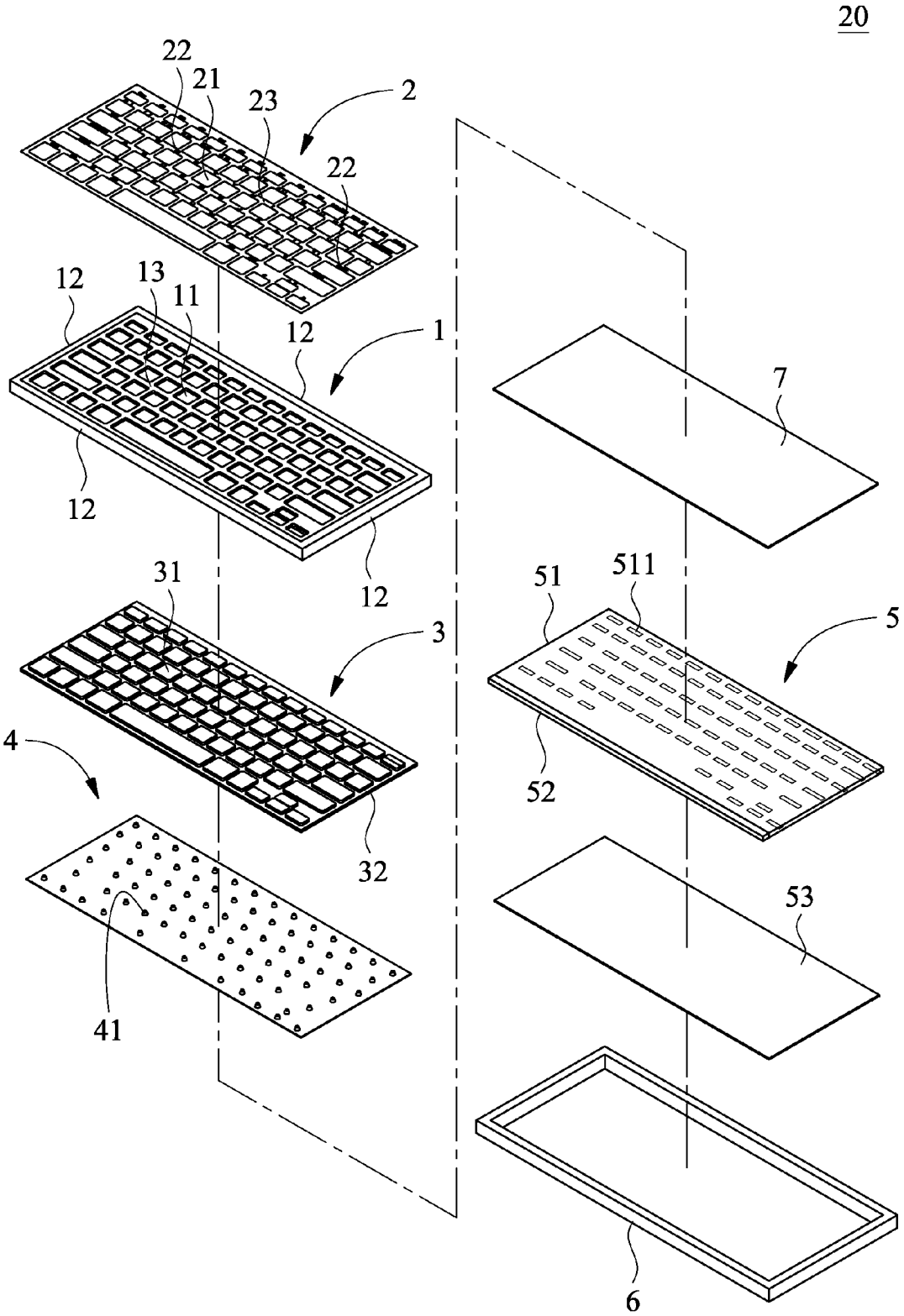
FIG. 2 is an exploded view of an illuminated keyboard according to an embodiment of the present invention.
Figure 3:
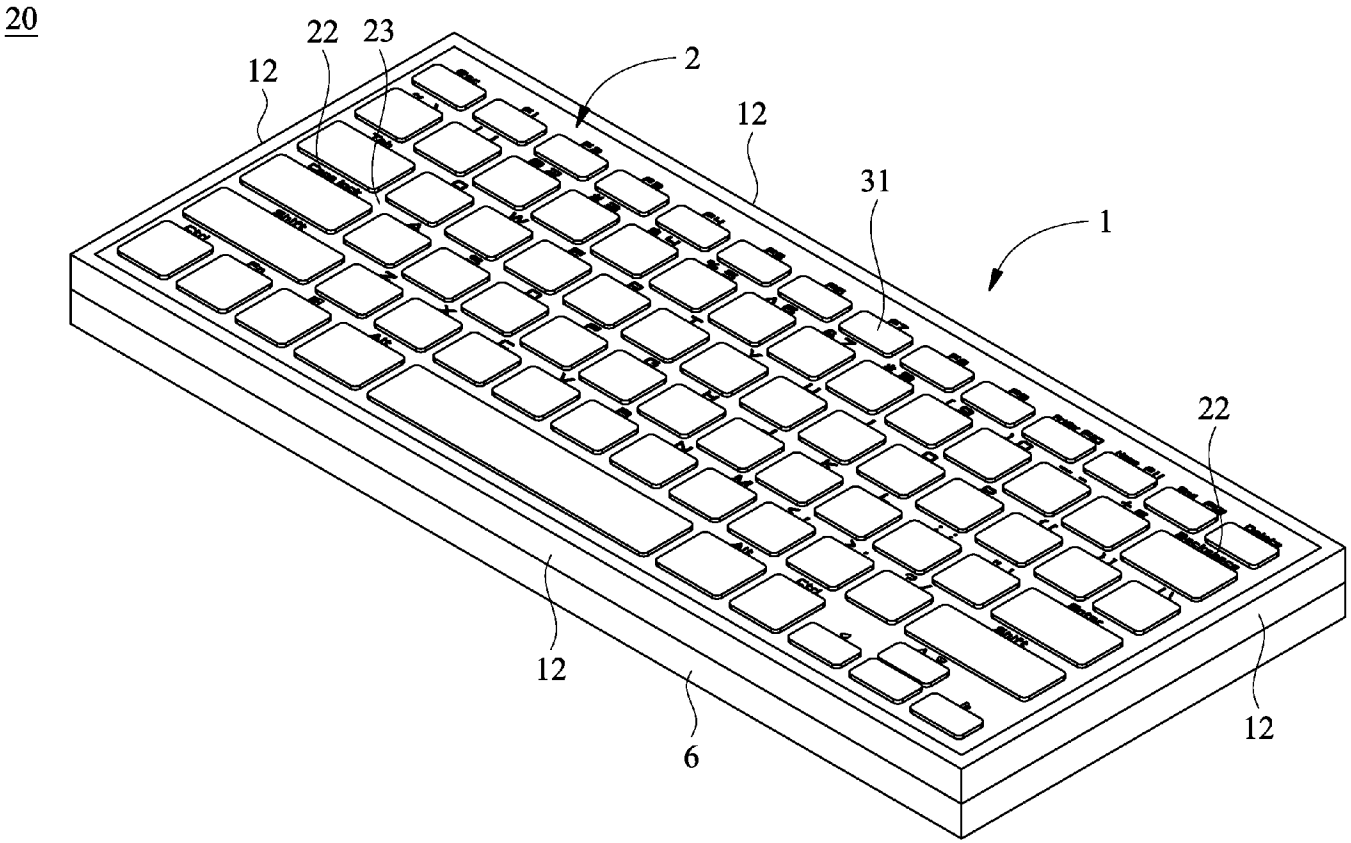
FIG. 3 is a schematic view of assembly of the illuminated keyboard according to an embodiment of the present invention.

Referring to FIG. 2 and FIG. 3, there are shown an exploded view and a schematic view of an illuminated keyboard 20 according to an embodiment of the present invention. As shown in the diagrams, in the second aspect of the present invention, the illuminated keyboard 20 comprises a light-permeable covering plate 1, a key symbol display plate 2, a key module 3, a light-permeable circuit film 4, a backlight device 5 and a bottom casing 6. The light-permeable covering plate 1 has a plurality of first key openings 11 for receiving a plurality of keys 31, respectively. The key symbol display plate 2 is disposed on the light-permeable covering plate 1. The key symbol display plate 2 adheres to the light-permeable covering plate 1. Alternatively, the key symbol display plate 2 is engaged with the light-permeable covering plate 1. Alternatively, the key symbol display plate 2 is fixed to the light-permeable covering plate 1 by whatever means. The key symbol display plate 2 has a plurality of second key openings 21 and a plurality of light-permeable key symbol blocks 22. The second key openings 21 receive the keys 31, respectively. The light-permeable key symbol blocks 22 come in the form of numerals, English letters, any foreign languages, and/or signs. The light-permeable key symbol blocks 22 are mounted on the support 23 of the key symbol display plate 2 and positioned proximate to the second key openings 21, respectively. For example, the light-permeable key symbol blocks 22 are positioned to the top, bottom, left or right of the second key openings 21. Moreover, the light-permeable key symbol blocks 22 correspond in position to the light-permeable support 13 of the light-permeable covering plate 1. Not only are the light-permeable key symbol blocks 22 on the key symbol display plate 2 light-permeable, the other parts and components of the key symbol display plate 2 are either light-permeable (for example, of sufficiently low transmittance to render the light-permeable key symbol blocks 22 visible) or opaque. The second key openings 21 correspond in position to the first key openings 11, respectively, such that the first key openings 11 and the second key openings 21 can receive the keys 31, respectively. The key module 3 is disposed beneath the light-permeable covering plate 1. The key module 3 has a plurality of keys 31 and a light-permeable key holding plate 32. The keys 31, which bear symbols or are blank, are spaced apart and disposed on the light-permeable key holding plate 32. The keys 31 are disposed in the first key openings 11 and the second key openings 21, respectively. The keys 31 are exposed from the second key openings 21 so that users can press the keys 31 as needed. The light-permeable circuit film 4 is disposed beneath the key module 3. The light-permeable circuit film 4 has a plurality of resilient components 41. The resilient components 41 are disposed beneath the keys 31, respectively, such that the keys 31 can restore their positions after being pressed and released. The light-permeable circuit film 4 generates and transmits a signal indicative of the pressing of the keys 31. The backlight device 5 is disposed beneath the light-permeable circuit film 4. The backlight device 5 is provided in the form of an electroluminescent plate (not shown) or in the form of a light guiding plate 51 with a light source 52. The light source 52 is provided in the form of an LED or an LED tube, and is disposed inside the light guiding plate 51 or at the edge thereof. For example, the light source 52 is disposed at the upper edge, lower edge, left edge or right edge of the light guiding plate 51. The light guiding plate 51 has therein a plurality of reflection blocks 511. The reflection blocks 511 correspond in dimension (i.e., the length and height of the symbols) and position to the light-permeable key symbol blocks 22. The area covered by the light emitted from the electroluminescent plate corresponds in dimension (i.e., the length and height of the symbols) and position to the light-permeable key symbol blocks 22. The bottom casing 6 is disposed beneath the backlight device 5 and coupled to the light-permeable covering plate 1 in a manner to enclose the key module 3, the light-permeable circuit film 4, and the backlight device 5.

As mentioned before, according to the present invention, the light-permeable key symbol blocks 22 of the illuminated keyboard 20 are disposed on the key symbol display plate 2, and thus it is not necessary to change the structure and constituent material of the keys 31 and any other parts and components beneath the keys 31 (to a light-permeable material, for example) so as to admit a light beam. Hence, according to the present invention, the illuminated keyboard 20 features a simple structure. Moreover, to apply the illuminated keyboard 20 of the present invention to different countries and have the symbols, including characters, presented in their respective languages, it is only necessary to change the key symbol display plate 2 but not necessary to change all the keys 31. For this reason, the illuminated keyboard 20 of the present invention incurs low manufacturing costs but is advantaged by a speedy manufacturing process. Furthermore, according to the present invention, the light-permeable key symbol blocks 22 of the illuminated keyboard 20 are disposed on the key symbol display plate 2, and thus the users' fingers are unlikely to hide the light-permeable key symbol blocks 22 when the users are operating the illuminated keyboard 20 in bright and dark environments, such that the users can instantly determine whether the symbols keyed in are correct. Furthermore, the users' fingers are unlikely to come into contact with the light-permeable key symbol blocks 22 when the users are operating the illuminated keyboard 20, and thus the light-permeable key symbol blocks 22 are unlikely to get blurred or smeared. Moreover, the reflection blocks 511 of the illuminated keyboard 20 correspond in dimension, position, and coverage of light emitted from the electroluminescent plate to the light-permeable key symbol blocks 22, respectively. Furthermore, no opaque structure which obstructs propagation of a light beam is disposed between the backlight device 5 and the key symbol display plate 2. With the light beam being able to penetrate the light-permeable key symbol blocks 22 entirely, the light-permeable key symbol blocks 22 are advantaged by optical performance characterized by uniform brightness.

As regards the illuminated keyboard 20, the light-permeable covering plate 1 is light-permeable in its entirety. Alternatively, the margin 12 of the light-permeable covering plate 1 is opaque, whereas the periphery of the first key openings 11 (that is, the support 13 of the light-permeable covering plate 1) is light-permeable, such that the light-permeable covering plate 1 demonstrates diversity in terms of light permeability.

As regards the illuminated keyboard 20, the key symbol display plate 2 is not only changeable but also variable in terms of pattern, color, and font of characters as needed. With the key symbol display plate 2 being changeable, the illuminated keyboard 20 can work with different said key symbol display plates 2 in order to assume diverse appearance. Moreover, to suit the illuminated keyboard 20 to different countries, it is only necessary to change the key symbol display plate 2, instead of all the keys 31, of the illuminated keyboard 20, thereby cutting manufacturing costs, speeding up the manufacturing process, and enhancing ease of use at an international level.

As regards the illuminated keyboard 20, the light-permeable key symbol blocks 22 are positioned to the top of the second key openings 21, respectively, to thereby fall into the range of the angles of view of the users, such that the users can instantly determine whether the symbols keyed in are correct.

The illuminated keyboard 20 further comprises a light-permeable fixing board 7 disposed between the light-permeable circuit film 4 and the backlight device 5.

The illuminated keyboard 20 further comprises a reflector 53 disposed between the backlight device 5 and the bottom casing 6. In the situation where the backlight device 5 is provided in the form of the light guiding plate 51 with the light source 52, the reflector 53 enables the light guiding plate 51 to manifest reflectance, and thus brightness, higher than is disclosed in the related prior art.

Figure 4:
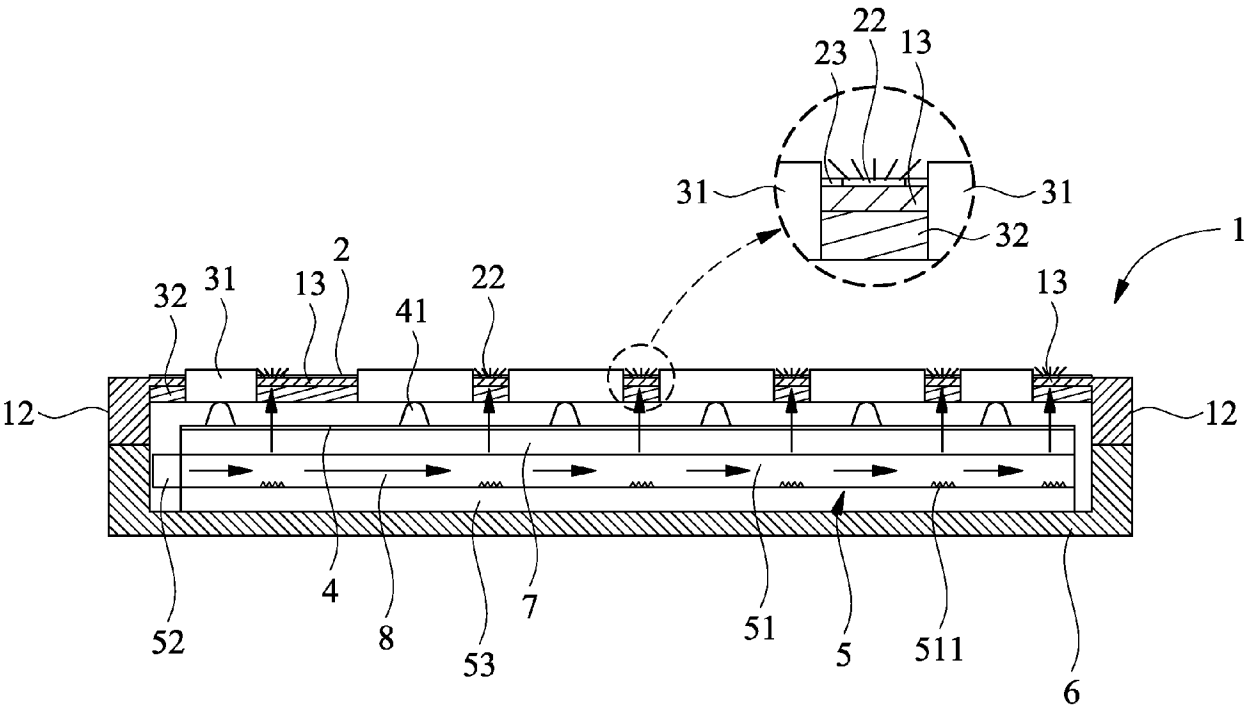
FIG. 4 is a schematic view of the light guiding of the illuminated keyboard according to an embodiment of the present invention.
Figure 5:
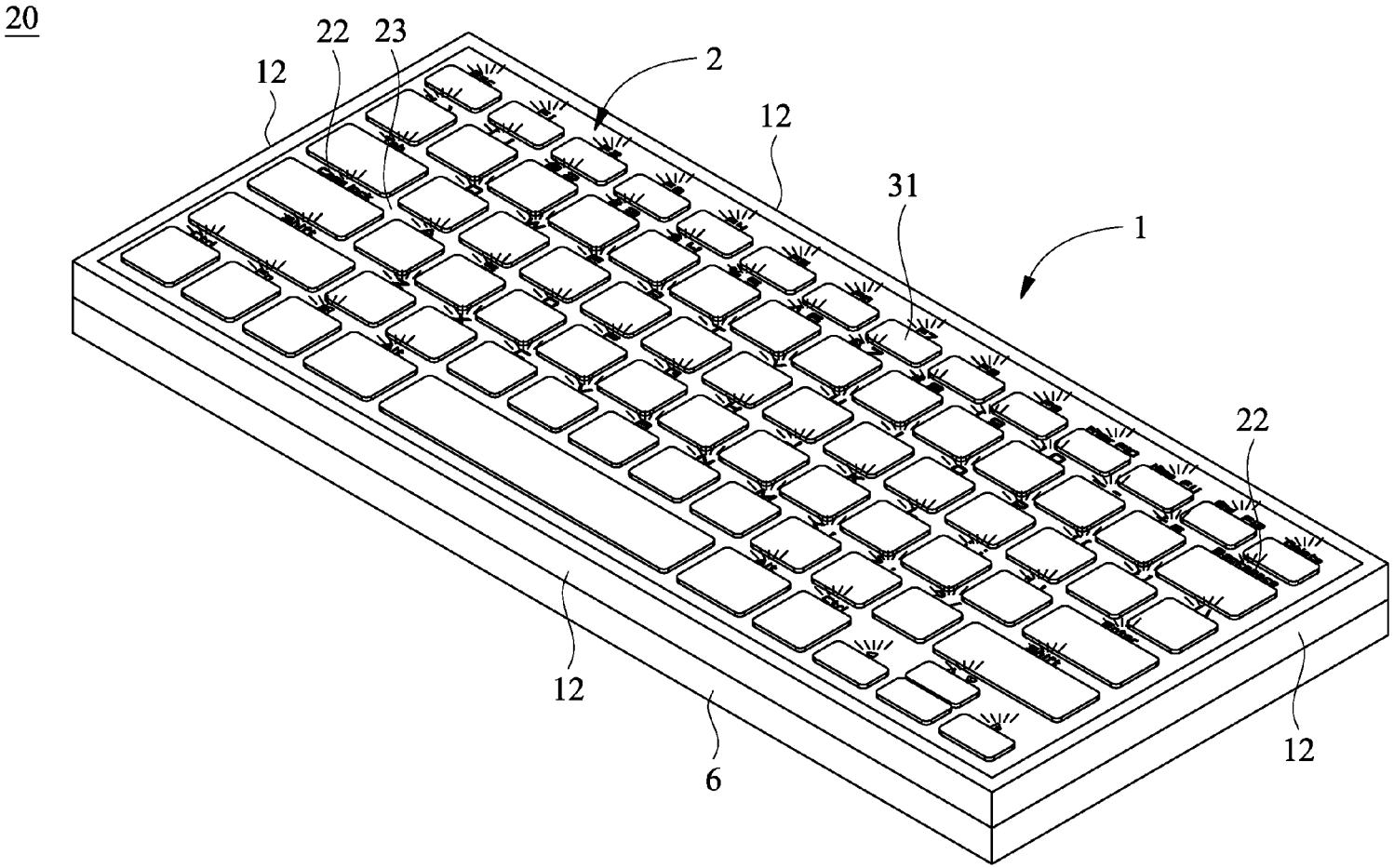
FIG. 5 is a schematic view of light emission of the illuminated keyboard according to an embodiment of the present invention.

Referring to FIG. 4 and FIG. 5, there are shown schematic views of the light guiding and light emission of the illuminated keyboard 20 according to an embodiment of the present invention, respectively. As shown in the diagrams, according to the present invention, the operation principle of the illuminated keyboard 20 is described as follows: the electroluminescent plate (not shown) or the light source 52 generates and emits a light beam 8; the light beam 8 reflects off the reflection blocks 511 to travel upward; the light beam 8 penetrates the light-permeable fixing board 7, the light-permeable circuit film 4, the light-permeable key holding plate 32, the light-permeable covering plate 1 and the light-permeable key symbol blocks 22 in sequence to thereby render the light-permeable key symbol blocks 22 luminous. Accordingly, the users working with the illuminated keyboard 20 in bright or dark environments can discern symbols displayed on the keys 31 and key in the symbols correctly.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. An illuminated keyboard, comprising:

a light-permeable covering plate having a plurality of first key openings;

a key symbol display plate disposed on the light-permeable covering plate and having a plurality of second key openings and a plurality of light-permeable key symbol blocks positioned proximate to the second key openings, respectively, the second key openings corresponding in position to the first key openings, respectively;

a key module disposed beneath the light-permeable covering plate and having a plurality of keys and a light-permeable key holding plate, the keys being disposed at the light-permeable key holding plate, spaced apart from each other, and disposed in the first key openings and the second key openings, respectively;

a light-permeable circuit film disposed beneath the key module;

a backlight device disposed beneath the light-permeable circuit film and provided in form of one of a light guiding plate with a light source and an electroluminescent plate, the light guiding plate having a plurality of reflection blocks corresponding in position to the light-permeable key symbol blocks, respectively, and the electroluminescent plate corresponding in position to the light-permeable key symbol blocks; and a bottom casing disposed beneath the backlight device and coupled to the light-permeable covering plate so as to enclose the key module, the light-permeable circuit film, and the backlight device.

2. The illuminated keyboard of claim 1, wherein the light-permeable covering plate is light-permeable in its entirety, or a margin of the light-permeable covering plate is opaque, and a periphery of the first key openings is light-permeable.

3. The illuminated keyboard of claim 1, wherein the key symbol display plate adheres to the light-permeable covering plate, is engaged with the light-permeable covering plate, or is changeable.

4. The illuminated keyboard of claim 1, wherein the light-permeable key symbol blocks are positioned to a top of the second key openings, respectively.

5. The illuminated keyboard of claim 1, further comprising a light-permeable fixing board disposed between the light-permeable circuit film and the backlight device.

6. The illuminated keyboard of claim 1, further comprising a reflector disposed between the backlight device and the bottom casing.

* * * * *